US005573361A

United States Patent [19]

Dyson et al.

[11] Patent Number: 5,573,361

[45] Date of Patent: Nov. 12, 1996

[54] SOCKET CLOSURE ARRANGEMENT FOR A SOCKET IN AN ARTICLE

[75] Inventors: Brian D. Dyson, Thorpe Bay; Martin Burgess, Beckenham; Ian J. Fullbrook, Billericay, all of England

[73] Assignee: Ford Motor Company, Dearborn, Mich.

[21] Appl. No.: 251,063

[22] Filed: May 31, 1994

[30] Foreign Application Priority Data

Jun. 3, 1993 [GB] United Kingdom ..... 93/11489

[51] Int. Cl.[6] ..... F16B 19/00

[52] U.S. Cl. ..... 411/373; 411/508; 411/908

[58] Field of Search ..... 411/508, 509, 411/908, 913, 338, 339, 373, 429

[56] References Cited

U.S. PATENT DOCUMENTS

| | | | |
|---|---|---|---|
| 915,068 | 3/1909 | Bowen | 411/373 |
| 1,755,590 | 4/1930 | Carr | 411/913 |
| 3,118,644 | 1/1964 | Werning | 411/908 |
| 3,233,502 | 2/1966 | Fernberg | 411/913 |
| 3,551,922 | 6/1971 | Watson | 411/373 |

FOREIGN PATENT DOCUMENTS

| | | | |
|---|---|---|---|
| 3113831 | 2/1982 | Germany | 411/373 |

*Primary Examiner*—Flemming Saether
*Attorney, Agent, or Firm*—Daniel M. Stock

[57] ABSTRACT

A socket end closure arrangement comprises a socket 4 in an article 5 and a closure 1 for the socket end. The closure 1 comprises a plug 2 for fitting into the socket 4, and to which plug 2 is attached, preferably tangentially, a disc-like flange 3. The plug 2 has spherically-arranged surfaces having a curvature substantially derived from the surface of a sphere and permitting selection of the orientation of the plug in fitting of the plug 2, preferably in interference-fit manner, into the socket 4 from a plurality of alternative orientations about at least one axis transverse to the longitudinal axis y of the socket 4. The flange 3 preferably locates into a surface recess 7 to become flush with the surface of the article 5. The plug may be physically structured in providing resilience and accordingly may be segmented 24. The axis y may be non-perpendicular to the plane of, or tangent to, the article surface, and the axis x of the recess 7 may not be aligned with axis y. In a second aspect, the invention provides a socket end closure.

1 Claim, 3 Drawing Sheets

SOCKET CLOSURE ARRANGEMENT FOR A SOCKET IN AN ARTICLE

BACKGROUND OF THE INVENTION

This invention relates to a closure arrangement for a socket end, and particularly, but not exclusively, for a tubular socket providing a recessed mounting hole in an article, particularly a molded article. The invention also relates to a closure for a socket end.

It has long been the tradition to conceal mounting devices, such as screws, in articles assembled together by providing a recess for the screw head and then closing off the recess above the screw head. In cases where the recess comprises a tubular socket, this has been achieved with a piece of wooden dowelling or with a plastic closure.

Because of the greater convenience provided by plastic closures, these have been generally favored where they are aesthetically acceptable. This is particularly so in the case of molded plastic articles where color-matching of a closure with the molded article can be readily achieved by the molder.

Traditionally, such plastic closures have had a cap-like profile, providing a short spigot for insertion into the recess or socket above the screw head, for example, and a substantially flat or domed top to sit proud of the surface of the article. Such plastic closures still detract from a pleasing appearance being presented by the fixed article.

In the environment of the interior of motor vehicles, the avoidance of unnecessary surface roughness is desirable from a safety as well as aesthetic point of view. However, if removal of the closure is a requirement in order to gain access to the mounting device for the purpose of removing the article, then a closure having a top which fits the recess would present difficulty in permitting its efficient removal. Still further, in the environment of the interior of a motor vehicle, it is important that such closures are not easily displaced from the recesses by vibration or by simply being dragged out, by the passage of clothing, for example, passing over them.

While the provision of deeply recessed mounting holes, for example, mounting holes at the bottoms of sockets, permit the use of closures having a longer spigot to assist their retention, these present the problem that for sockets having an axis nonperpendicular to the plane of the surrounding surface of the article or to a tangent drawn at a point where the axis cuts a projection of said surface across the socket, they have generally required closures to be specifically designed. This is particularly so if the top of the closure is to be flush with that surface on fitting the spigot in the socket.

SUMMARY OF THE INVENTION

According to one aspect of the present invention, there is provided a socket closure arrangement comprising a socket in an article and a socket end closure for the end of the socket, which closure comprises a plug for fitting into the socket from an open end and having attached thereto a disc-like flange for closing off said end, wherein the plug has spherically arranged surfaces having a curvature substantially derived from the surface of a sphere for contacting the inner wall of the socket in fitting the plug into the socket and permitting selection of the orientation of the plug in the fitting of the plug into the socket from a plurality of alternative orientations of the plug about at least one axis transverse to the longitudinal axis of the socket.

According to a second aspect of the present invention, there is provided a socket end closure for a socket in an article, said closure comprising a plug for fitting into the socket from an open end and having attached thereto a disc-like flange for closing off said end, wherein the plug has spherically arranged surfaces having a curvature substantially derived from the surface of a sphere for contacting the inner wall of the socket in fitting the plug into the socket and permitting selection of the orientation of the plug in the fitting of the plug into the socket from a plurality of alternative orientations of the plug about at least one axis transverse to the longitudinal axis of the socket.

By means of this invention, the number of different socket closure designs necessary to suit a variety of sockets having longitudinal axes, which are not normal to or not perpendicular to the article surfaces in which they are situated, can be considerably reduced. This, in turn, not only reduces the cost of closure production, but also simplifies manufacturing operations involving the fitting of closures to a variety of socket types.

The socket, being a socket in an article and having an open end, may be a container, for example, but is preferably a socket providing a recessed mounting hole. The article is preferably a molded article and especially a molded motor vehicle panel.

The spherically arranged surfaces of the plug, which may merge, for example, into a continuous surface, have a common center of curvature and are arranged such that the plug can be fitted into the socket, for example, in interference fit or locking manner, to at least releasably hold the plug in the socket. The spherically arranged surfaces may be arranged over the whole profile of a sphere or over only a portion thereof. Accordingly, the spherically arranged surfaces may be confined to a hemispherical portion or to some other geometric portion of a sphere.

Preferably, the spherically arranged surfaces permit selection of the orientation of the plug in the fitting of the plug into the socket from a plurality of alternative orientations of the plug about at least two and more, preferably all, axes perpendicular to the longitudinal axis of the socket.

Fitting of the plug in the socket may take advantage of any resilience in the wall of the socket. While it is envisaged that the socket will generally have a substantially circular cross-sectional shape at right angles to its longitudinal axis, other cross-sectional shapes are clearly possible, provided the plug can be fitted into the socket. The plug may lock over or into, for example, an annular rib or depression, or one or more other protrusions, depressions or edges, such as the edges of longitudinal slots provided on the inner wall of the socket, but fitting of the plug is preferably in interference-fit manner.

In the molding of the socket from plastic material, withdrawal of the male molding tool from the molded socket is facilitated by providing a slight taper on the tool and thereby on the internal dimensions of the socket. Such a taper can adversely affect the retention of the plug in the socket unless the plug locks over or into a device such as referred to above.

The selection of the orientation of the plug in the fitting of the plug into the socket may be arrived at in the process of fitting the plug in the socket and aligning the disc-like flange as desired, for example, with the surface of the article with which the external surface of the flange may be required to be made flush.

However, it will be appreciated that the selection of the orientation of the plug in the fitting of the plug into the socket may, to some extent, be determined by the attitude of the socket in relation to the article surface, for example, the angle, if any, the longitudinal axis of the socket makes with a perpendicular to the plane of the surrounding surface of the article or to a tangent drawn at a point where the axis cuts a projection of said surface across the socket.

The diameter on which the common center of curvature of the spherically arranged surfaces lies is preferably less than the depth of the socket. More preferably, the said diameter plus the thickness of the disc-like flange, especially if attached substantially tangentially to the plug, is less than the depth of the socket. However, it will be appreciated that if the spherically arranged surfaces are arranged over only a portion of a sphere, the said diameter may be equal to or greater than the depth of the socket.

The plug is preferably a substantially spherically shaped boss.

It is preferred that the plug has some resilience, whereby a degree of control over the fit of the plug in the socket may be achieved and some adaptability to sockets of varying sizes or nonuniformity is built in. This resilience may be achieved by employing a resilient or flexible material in the manufacture of the plug and/or physically structuring the plug as by segmenting a boss, such as is illustrated hereinbelow. While a boss may be of hollow construction, it is preferably of solid construction. Alternatively, the plug may comprise two or more arcuate finger-like projections from the flange, as also illustrated hereinbelow, and providing the spherically arranged surfaces. Such arcuate finger-like projections lend themselves to locking over the edges of longitudinal slots which may be provided in the wall of the socket, which slots are of such depth and width as to permit selection of the orientation of the plug to be fitted into the socket from a plurality of alternative orientations of the plug about at least one axis transverse to the longitudinal axis of the socket.

If the plug and/or the socket has some resilience, the diameter on which the spherically arranged surfaces lie can be greater than that of the circle on which the areas of the socket wall to be contacted lie.

The plug may be of a metal or plastic material such as aluminium, brass, copper, polyethylene (high or low density, including linear low density), PVC, nylon or toughened polystyrene, to name a few of some such materials.

The disc-like flange of the socket end closure of this invention is preferably integrally attached to the plug. The flange may be hinged to the plug by a living plastic hinge, but it is preferred that the flange and the plug are relatively rigidly attached to one another. Further, it is preferred that the flange is attached substantially tangentially to the plug. The flange is preferably of solid construction.

The diameter of the flange is preferably greater than that of the plug, and preferably of such size and cross-sectional shape as to locate into a surface recess which may be provided at least partly around the open end of a socket in an article such as a board or panel, which panel may be an interior panel of a motor vehicle. While such a surface recess may be axially aligned with the socket, the axis of such a surface recess may be at an angle to that of the socket, especially if the socket end closure of this invention is to be used for a socket with an axis nonperpendicular to the plane of the surface surrounding the socket or to a tangent drawn at a point where the axis cuts a projection of said surface across the socket. The dimensions of the flange and of the surface recess are preferably such that the flange will become flush with the surface of the article surrounding the socket and/or surface recess.

It will be appreciated that the fitting of the plug in the socket can be such as to adequately hold the closure in place. Accordingly, it is not necessary for the flange to tightly fit any surface recess, which may have a tapered edge, provided around the end of the socket for holding purposes. Indeed, it is preferred that some provision is made at the edge of the flange for the access of a closure removal tool and, therefore, that the location of the flange into any such surface recess is sufficiently loose to permit the access of, for example, a prying tool, for the removal of the closure to gain access beneath. This expedient avoids the provision of a notch or cut-out in the edge of the flange for this purpose. Removal of the closure is particularly desirable if the socket end closure is employed for a mounting hole socket, for example, in an article comprising a motor vehicle panel, such as a dashboard panel or console, which may need to be temporarily removed to service vehicle instruments or gear selection mechanisms.

The edge of the flange is preferably tapered so that the larger diameter is outermost when the closure is in use, the taper preferably being angled to suit the socket and/or recess surrounding the socket to which it becomes adjacent in use and vice-versa.

It will be appreciated that if the edge of the flange is provided with a taper, the angle of the taper may be such that in providing recesses around sockets with which the closure is to be used, the edges of the recesses may be formed to suit the flange edge while avoiding undercut or re-entrant surfaces.

The flange is preferably comprised of the same material as the plug with which it is preferably integrally molded.

BRIEF DESCRIPTION OF THE DRAWINGS

The present invention will now be illustrated by way of example with reference to the accompanying drawings in which.

In the drawings, like numbers correspond.

DESCRIPTION OF THE PREFERRED EMBODIMENTS

Figure 1:
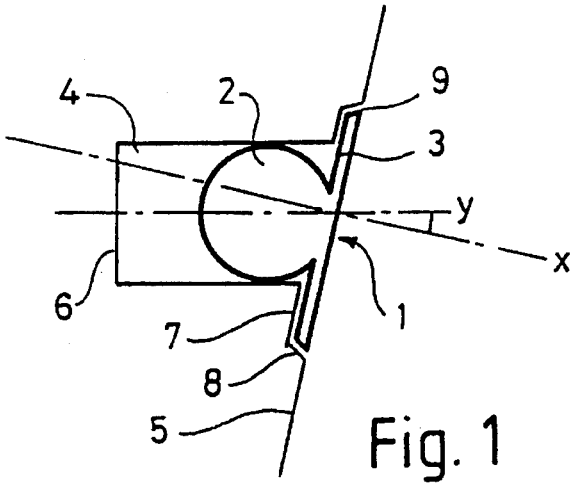
FIG. 1 is a cross-sectional view of a socket closure arrangement according to this invention showing a hollow socket end closure in use for a tubular socket having an axis non-perpendicular to the plane of the surface of the article in which the socket is provided and showing a recess immediately surrounding the socket end.

FIG. 1 shows a hollow socket end closure 1 comprising a plug, in the form of a substantially spherically shaped boss 2, to which is integrally molded a flange 3. The hollow closure 1 may be produced by rotational casting of polyethylene. The diameter of the boss 2 is such that it fits in interference manner into a socket 4 having a longitudinal axis y and molded in a panel 5. The socket 4 has a substantially circular cross-sectional shape at right angles to its axis y and has a base 6 which is provided with a mounting hole (not shown) for a screw mounting the panel 5. The panel 5 may be of molded toughened polystyrene by injection or draw molding. The socket 4 has its longitudinal axis y nonperpendicular to the plane of a panel 5 and at its outward end is surrounded by the surface recess 7, having an axis x at an angle to the axis y of the socket, the periphery of which recess tapers outwardly at 8 towards the external surface of the panel 5. The axis x of recess 7 is at an angle to the axis y of the socket 4. The flange 3 has a tapered edge 9, the taper corresponding to the taper 8 of the recess 7. The diameter of the flange 3 is slightly less than the diameter of the recess 7, thereby facilitating the insertion of a removal tool for the closure 1. Alternatively, a notch could be formed in the circumference of the flange 3 for the same purpose. For the sake of clarity, the flange 3 is shown to be spaced from the recess 7, particularly the base of the recess. In practice, the flange 3 will be seated on the base of the recess. However, because of the interference fit of the boss 2 in socket 4, it is not necessary that the tapered edge 9 of the flange is gripped by the tapered edge 8 of the recess. Again, in practice, the thickness of the flange 3 will be equal to the depth of the recess 7 so that when the flange 3 is properly seated on the base of recess 7, the external surface of the flange 3 will be aligned with the external surface of the panel 5 to be substantially flush therewith.

A modification (not shown) of the socket 4 of FIG. 1 includes a protrusion on the inside wall of the socket over which the contact diameter of the boss 2 locks. The protrusion is an annular rib or one or more dot projections.

Figure 1A:
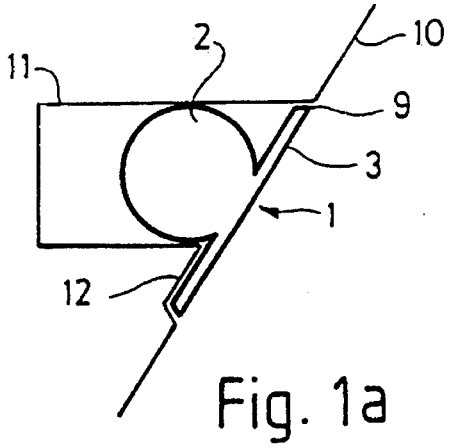
FIG. 1*a* is a cross-sectional view of a socket closure arrangement showing a hollow socket end closure identical to that shown in FIG. 1, but in use for a tubular socket having an axis at a greater angle to the perpendicular and showing an arcuate recess adjacent the socket end.

In FIG. 1*a*, a hollow socket end closure, identical to that illustrated in FIG. 1, is shown in use for a socket 11 of similar circular cross-sectional shape to socket 4, but having a longitudinal axis at a greater angle to a line perpendicular to the plane of the surface of a panel 10 (similar to panel 5) than in FIG. 1. It will be seen that the substantially spherically shaped boss 2 fits in interference manner in the socket 11, the boss 2 and the flange 3 having been rotated in a clock-wise direction within the socket 11, in going from FIG. 1 to FIG. 1*a*, about an axis (a point on axis x) perpendicular to the longitudinal axis of the socket, to permit the external surface of flange 3 to be aligned and flush with the external surface of panel 10. Owing to the angle of the socket 11 and the relative diameter of the flange 3, it is in this case not necessary for the socket to be provided with a recess completely around its outward end, and surface recess 12 is arranged to merge (not shown) into the socket periphery in order to secure the above flush arrangement of the flange 3 and panel 10. As in FIG. 1, for the sake of clarity, the flange 3 is shown spaced from the base of the recess 12, and the spacing between the tapered surface 9 of the flange 3 and the surrounding surfaces of the recess and socket is exaggerated, but a tight fit is avoided.

Figure 2:
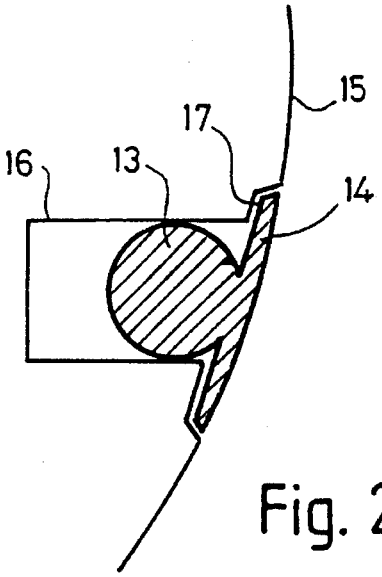
FIG. 2 is a cross-sectional view of a solid socket end closure having a domed flange and in use for a socket in a curved surfaced article and having a recess for the flange.

FIG. 2 shows a socket end closure similar to that shown in FIG. 1, but having a plug including a boss 13 of solid construction, as may be produced by injection molding of polyethylene, and provided with a domed flange 14 having a curvature to conform to that of the curvature of panel 15 similarly constructed to panel 5 of FIG. 1. Socket 16, which has an axis nonperpendicular to a tangent drawn where the axis cuts a projection of the panel surface across the socket 16, is provided with a surface recess 17 around its outer end to accommodate the flange 14, whereby, in the manner previously described, the external surface of flange 14 is permitted to become flush with the external surface of panel 15 and complement its curved surface. The longitudinal axis of the socket 16 meets a tangent to the curvature of the panel 15 in nonperpendicular fashion.

Figure 3:
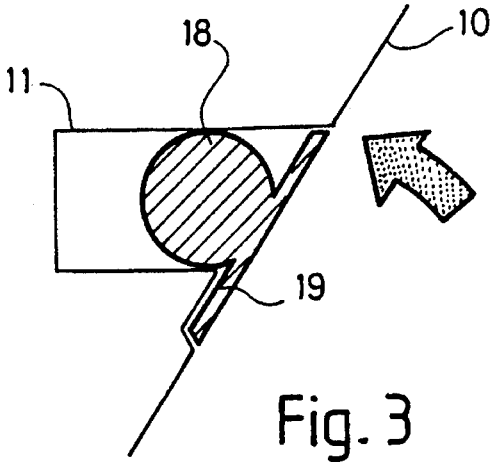
FIG. 3 is similar to FIG. 1*a*, but wherein the socket end closure according to this invention is solid and showing the angle of the taper on the flange conforming with the edge of the socket and recess with which it becomes adjacent in use.

FIG. 3 is similar to FIG. 1*a*, but shows the socket end closure as a solid construction comprising the boss 18 and the flange 19, which may be integrally injection molded from polyethylene. In FIG. 3, an arrow indicates how such an arrangement of socket end closure and socket can provide a means to assist removal of the closure from the socket. Pressure applied in the direction of the arrow may serve to rotate the boss 18 in the socket 11 to bring an edge of the flange 19 proud of the external surface of panel 10, whereby it can be gripped to remove the closure from the socket 11. Other details of FIG. 3 are similar to those discussed with reference to FIG. 1*a*.

Figure 4:
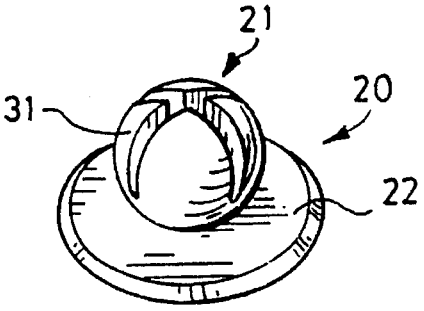
FIG. 4 is a perspective view of a solid socket end closure according to this invention and of which the boss is segmented.

FIG. 4 illustrates a socket end closure 20, according to this invention, and comprising a boss 21 and flange 22 integrally molded by injection molding from toughened polystyrene. The boss 21 is formed with a segmented structure to provide the boss with enhanced resilience in directions in which applied forces will tend to close up the spacings between the segments 31. By employing such an expedient, the range of sockets for which a socket end closure may be used can be extended, particularly where there is a small variation in socket diameter.

Figure 5:
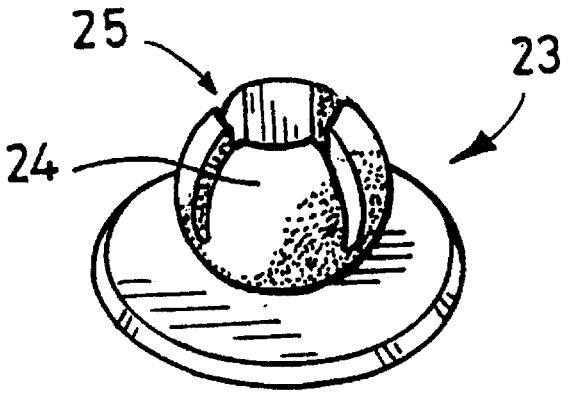
FIG. 5 is a perspective view of another socket end closure according to this invention.

FIG. 5 illustrates another socket end closure 23 which is similar to that shown in FIG. 4, but having the segments 24 of the plug 25 reduced in size by omitting some otherwise redundant material from their construction. This has the effect of increasing the resilience of the plug 25 as well as rendering the closure more economical on material cost.

Figure 6:
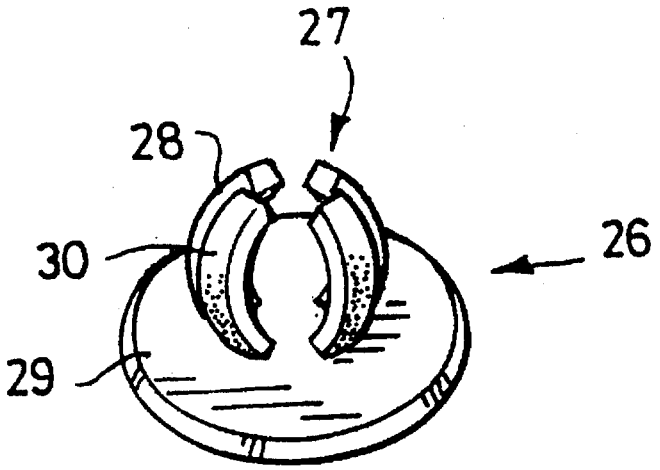
FIG. 6 is a perspective view of yet another socket end closure according to this invention wherein the plug comprises multiple finger-like projections.

FIG. 6 illustrates yet another socket end closure 26 and comprising a plug 27 constituted by four equally spaced arcuate fingers 28 integrally molded with the flange 29 by injection molding from polypropylene. The fingers 28 have outer surfaces 30 which have a common center of curvature. The outer surfaces 30 have a curvature substantially derived from the surface of a sphere.

Figure 7:
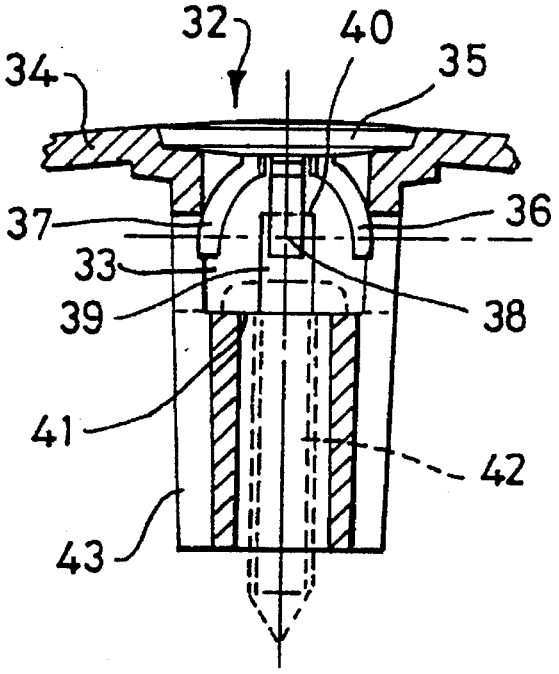
FIG. 7 is a schematic cross-sectional view of a socket closure arrangement employing a modified form of the socket end closure shown in FIG. 6.

FIG. 7 shows a socket closure arrangement comprising a socket end closure 32 and a socket 33 of circular cross-sectional shape, transverse to its longitudinal axis, molded in the surface of an article 34. The socket end closure 32 comprises a disc-like flange 35 having a surface profile conforming to the curvature of the surface of the article 34. The flange 35 is shown to have a tapered edge matching the edge of a surface recess in the article into which the flange is seated. The angle of the taper is 15 degrees to a line parallel to the socket axis. The closure 32 also comprises four equally angularly spaced arcuate finger-like projections 36 integrally molded with the flange 35. The four finger-like projections 36 constitute the plug of the closure 32. The outward surfaces 37 of the projections 36 have a curvature substantially derived from the surface of a sphere and are arranged over only a geometric portion of a sphere, the approximate center of which is indicated by 38.

The socket end closure 32 and the article 34 with the socket 33 are injection molded from polypropylene.

As is shown, the socket 33 is provided with a tapered inner wall to assist molding tool removal. Around the wall of the socket 33 there are also provided four equally angularly spaced longitudinal slots 39 which pass through the wall of the socket 33 to provide, on the inner wall of the socket 33, four equally spaced slot edges 40 over which the outward surfaces 37 of the projections 36 can lock. The positions of the edges 40 are such that they lie above the sphere center 38.

The slots 39 may be simply formed during the injection molding of the socket by employing a female tool having internal longitudinally arranged lands which contact the surface of the male tool in regions corresponding to the four slots 39.

The socket 33 is provided with a mounting hole 41 in its base and into which is inserted a mounting screw 42 (shown dotted). Integral with the wall of the socket 33 is shown a spacer projection 43 which is optional and can be molded to any length to suit the position of the article 34 in relation to a vehicle frame, for example, to which it is to be fixed.

The width of the slots 39 is such as to permit selection of the orientation of the plug, comprised of projections 36, in the fitting of the plug into the socket, from a plurality of alternative orientations about all axes passing through center 38 and at right angles to the axis of the socket 33.

The diameter of the sphere having the center 38, and over a portion of which the outward surfaces 37 of projections 36 are arranged, is dimensioned to be 0.5 mm greater than the diameter of the socket at the position of edges 40. In this way, the projections 36 can resiliently lock over edges 40 in fitting the plug into the socket.

Figure 8:
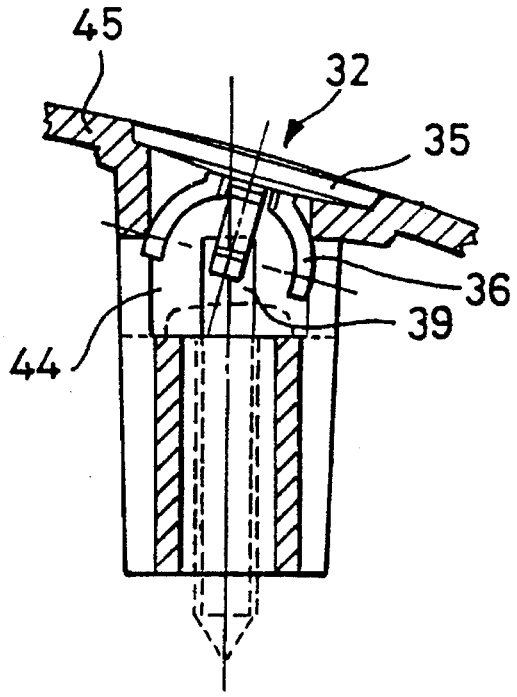
FIG. 8 is a schematic cross-sectional view of a socket end closure identical to that shown in FIG. 7, but employed with a socket having a longitudinal axis which is nonperpendicular to a tangent drawn at a point where the axis cuts a projection of the surrounding article surface across the socket.

FIG. 8 illustrates a socket closure arrangement comprising a socket end closure 32 identical to that shown in FIG. 7 and a socket 44 which is identical to socket 33 of FIG. 7, with the exception that it is molded in the surface of an article 45 such that its longitudinal axis is nonperpendicular to a tangent drawn at a point where the axis cuts a projection of the surrounding article surface across the socket. Also, unlike FIG. 7, the axis of the surface recess is at an angle of approximately 15 degrees to the longitudinal axis of the socket 44 to permit the flange 35 to seat in the surface recess and to become flush with the surface of the article 45, similar to FIG. 7. In fitting the plug, comprising projections 36, into the socket 44, it has been rotated, relative to FIG. 7, about an axis perpendicular to the plane of the paper, through an angle of approximately 15 degrees as permitted by the width of the slots 39.

Having described a preferred embodiment of our invention, what we claim and desire to secure by U.S. Letters Patent is:

1. A closure arrangement in combination with an article, comprising:

a socket of circular cross-section formed in the article, the socket having a longitudinal axis and having an open end;

a plug inserted into said socket open end and having spherical surfaces formed thereon rotatably engageable within said socket to permit rotative orienting movement of said plug with respect to said socket about said socket longitudinal axis;

a disk-like flange attached substantially tangentially to said plug and overlying said socket open end upon insertion of said plug into said socket; and a surface recess formed at least partly around the open end of the socket, and having an axis at an angle to said socket longitudinal axis, the recess substantially receiving said disk-like flange.

* * * * *